US006132236A

United States Patent [19]

Kozel et al.

[11] Patent Number: 6,132,236

[45] Date of Patent: Oct. 17, 2000

[54] FLEX CABLE TERMINATION APPARATUS AND TERMINATION METHOD

[75] Inventors: Charles A. Kozel, McHenry; John T. Scheitz, Barrington; Mark Stack, Streamwood, all of Ill.

[73] Assignee: Methode Electronics, Inc., Chicago, Ill.

[21] Appl. No.: 09/311,843

[22] Filed: May 14, 1999

[51] Int. Cl.[7] ..... H01R 4/24

[52] U.S. Cl. ..... 439/395

[58] Field of Search ..... 439/404, 406, 439/395

[56] References Cited

U.S. PATENT DOCUMENTS

| | | | |
|---|---|---|---|
| 3,701,964 | 10/1972 | Cronin | 339/17 F |
| 3,772,775 | 11/1973 | Bonnke et al. | 29/628 |
| 3,876,964 | 4/1975 | Balaster et al. | 333/84 M |
| 3,994,554 | 11/1976 | Navarro | 439/406 |
| 4,065,199 | 12/1977 | Andre et al. | 339/17 F |
| 4,240,687 | 12/1980 | Bunnell et al. | 339/99 R |
| 4,256,359 | 3/1981 | Storck | 339/97 C |
| 4,289,370 | 9/1981 | Storck | 339/125 R |
| 4,302,065 | 11/1981 | Taylor | 339/17 F |
| 4,323,295 | 4/1982 | Davis, Jr. | 339/107 |
| 4,439,001 | 3/1984 | Curley et al. | 339/176 M |
| 4,446,330 | 5/1984 | Nager, Jr. | 174/51 |
| 4,463,998 | 8/1984 | Reavis et al. | 339/40 |
| 4,466,687 | 8/1984 | Frantz | 439/395 |
| 4,479,692 | 10/1984 | Greenwood et al. | 339/99 R |
| 4,480,889 | 11/1984 | Greenwood | 339/99 R |
| 4,486,949 | 12/1984 | Allen | 29/861 |
| 4,554,733 | 11/1985 | Caveney | 29/749 |
| 4,563,050 | 1/1986 | Greenwood et al. | 339/99 R |
| 4,564,254 | 1/1986 | van Alst | 339/99 R |
| 4,630,879 | 12/1986 | van Alst | 339/99 R |
| 4,655,528 | 4/1987 | Groft | 439/404 |
| 4,705,481 | 11/1987 | Prichard | 439/417 |
| 4,741,099 | 5/1988 | Olsson | 29/749 |
| 4,767,352 | 8/1988 | Pretchel | 439/395 |
| 4,773,876 | 9/1988 | Nakamura et al. | 439/417 |
| 4,820,188 | 4/1989 | Collier et al. | 439/395 |
| 4,824,394 | 4/1989 | Roath et al. | 439/395 |
| 4,867,700 | 9/1989 | Krienberg | 439/422 |
| 4,891,020 | 1/1990 | Dunn | 439/405 |
| 4,902,245 | 2/1990 | Olsson | 439/492 |
| 4,946,390 | 8/1990 | Smyers | 439/404 |
| 4,971,572 | 11/1990 | Hopper | 439/407 |
| 4,995,827 | 2/1991 | Rudoy | 439/405 |
| 5,007,858 | 4/1991 | Daly et al. | 439/498 |
| 5,022,868 | 6/1991 | Legrady | 439/399 |
| 5,057,650 | 10/1991 | Urushibata et al. | 174/88 R |
| 5,076,800 | 12/1991 | Milnes et al. | 439/394 |
| 5,078,616 | 1/1992 | Nemcovsky | 439/404 |
| 5,080,604 | 1/1992 | Rider et al. | 439/357 |
| 5,108,306 | 4/1992 | Wellinski | 439/404 |
| 5,190,480 | 3/1993 | Chau et al. | 439/637 |
| 5,219,303 | 6/1993 | Daly et al. | 439/422 |

(List continued on next page.)

*Primary Examiner*—Khiem Nguyen
*Assistant Examiner*—Brian S. Webb
*Attorney, Agent, or Firm*—Karl D. Kovach; David L. Newman

[57] ABSTRACT

An insulation displacement contact for connecting to a flat conductor of a flat cable, where the flat conductor has a width dimension greater than its thickness dimension. The insulation displacement contact including a base, a first tine connected to the base and a second tine connected to the base. The first tine having a first edge and a second edge. The first edge being adjacent to a free end, where the free end has a first knife edge. The second tine having a third edge and a fourth edge. The third edge being adjacent to a free end, where the free end has a knife edge. The third edge of the second tine opposes the first edge of the first tine. The first edge of the first tine being separated from the third edge of the second tine by a first distance. The fourth edge of the second tine opposes the second edge of the first tine. The second edge of the first tine being separated from the fourth edge of the second tine by a second distance. The first distance being greater than the second distance. A support surface positioned between the first tine and the second tine so as to urge the conductor towards the base.

26 Claims, 13 Drawing Sheets

U.S. PATENT DOCUMENTS

| | | | |
|---|---|---|---|
| 5,226,835 | 7/1993 | Baker et al. | 439/403 |
| 5,273,447 | 12/1993 | Heiney et al. | 439/160 |
| 5,389,741 | 2/1995 | Ueno | 174/117 |
| 5,472,348 | 12/1995 | Daly et al. | 439/76.1 |
| 5,474,468 | 12/1995 | Chishima et al. | 439/495 |
| 5,525,072 | 6/1996 | Kunishi | 439/495 |
| 5,525,078 | 6/1996 | Springer | 439/610 |
| 5,620,331 | 4/1997 | Los et al. | 439/404 |
| 5,622,516 | 4/1997 | Baggett et al. | 439/408 |
| 5,641,312 | 6/1997 | Bippus et al. | 439/709 |
| 5,647,760 | 7/1997 | Drach et al. | 439/395 |
| 5,690,510 | 11/1997 | Chishima | 439/496 |
| 5,695,348 | 12/1997 | Legrady | 439/78 |
| 5,761,796 | 6/1998 | Imgrut et al. | 29/748 |
| 5,779,498 | 7/1998 | Asakawa | 439/495 |
| 5,785,548 | 7/1998 | Capper et al. | 439/409 |
| 5,800,200 | 9/1998 | Brioaud et al. | 439/404 |
| 5,820,403 | 10/1998 | Cheng et al. | 439/404 |
| 5,821,465 | 10/1998 | Tanaka et al. | 174/88 |
| 5,824,955 | 10/1998 | Saiso et al. | 174/88 R |
| 5,893,775 | 4/1999 | Annokkee et al | 439/495 |
| 5,934,932 | 8/1999 | Ito | 439/495 |
| 5,944,554 | 8/1999 | Armand et al. | 439/499 |

FLEX CABLE TERMINATION APPARATUS AND TERMINATION METHOD

BACKGROUND OF THE INVENTION

1. Field of the Invention

The present invention pertains to termination devices and a termination method. The invention more particularly concerns termination devices and a termination method which terminate flat conductors of a flat cable.

2. Discussion of the Background

Devices are well known in the art for terminating flat conductors of flat cables. A flat conductor is a conductor having a width dimension which is greater than its thickness dimension. The conductors are used to convey electricity. A flat cable is a cable which bundles together two or more conductors, where the conductors lie in the same plane. Known to the art are flat cables constructed from round conductors and flat cables constructed from flat conductors. Round conductors have a circular cross-section. However, this application concerns itself with flat cable constructed from flat conductors, where the cross-sectional shape of the conductor is generally rectangular. Flat conductors typically have a thickness of approximately 0.007 inches. Flat conductors having a thickness of 0.002 inches, or less, crosses over into the realm of flex circuitry and is not deemed pertinent to this discussion.

Typically, three different methods of constructing flat cable exist. The first method involves the steps of placing conductors between two insulator layers. The insulator layers bonded to each other and to the conductors by way of an adhesive; heat may also be used to help secure the bonding process. The second method involves the step of extruding the insulator material around the conductors. The third method of constructing flat cable includes the step of placing conductors between two insulator layers. The insulator layers being bonded to each other by way of sonic welding so as to trap the conductors between the insulator layers without the insulator layers being bonded to the conductors.

Often, flat cable is chosen for an application because of one of two advantages. One advantage of flat cable is that it provides a low profile. A low profile cable can be placed innocuously underneath floor carpeting, between a door frame and a door panel, or between a headliner and a roof of a vehicle. The second advantage of flat cable is that it is relatively flexible. A flexible cable can be placed inside a clockspring of a vehicle. A clockspring provides for the electrical connection between stationary crash sensors to a rotatably mounted airbag assembly on a vehicle. As such, the flat cable within the clockspring is repeatedly flexed or wound and unwound during the lifetime of the vehicle in which it is installed. Both applications require that the insulating layer not only have superb dielectric qualities, the insulating layers must be tough so as to withstand repeated flexure and industrial type environments.

Insulator layer material which satisfies such requirements includes polyester materials, namely MYLAR by E. I. Du Pont De Nemours and Company. MYLAR type polyester insulating layer film material is economical and has adequate dielectric properties while at the same time adequately whithstands industrial environmental hazards and endures large numbers of flexure before failure occurs.

Various methods of terminating or tapping into a flat cable exist such as crimping, welding, staking, and cutting insulation by way of an insulation displacement contact (IDC).

U.S. Pat. No. 5,389,741 discusses crimping. The crimping process involves the placement of a connection terminal in contact with the conductor by way of sliding the connection terminal in between the conductor and the insulation sheath. Crimping claws are then employed to surround the overlapping portion of the connection terminal and the conductor. The claws are bent so as to press the two pieces together. The crimping technique is time consuming and labor intensive.

U.S. Pat. No. 4,902,245 discusses staking. The staking process includes the steps of placing holes in the conductor and in the termination device. The holes of the two parts are then aligned so as to be coaxial. A copper insert is then placed in the coaxially aligned holes. The ends of the inserts are then upset so as to form heads being larger than the holes so as to secure the two parts together. This technique is also time consuming and labor intensive.

U.S. Pat. No. 4,705,481 discusses cutting by way of an insulation displacement contact. The patent discloses an IDC for connecting to a flat conductor of a flat cable, where the conductors are sheathed in a polymer film. The IDC includes a square piece of material having each of its four corners bent upwards so as to provide four sharp contact points. The four sharp contact points penetrate the polymer layer and make contact with the conductor. The construction and geometry of the IDC is complex and costly.

Furthermore, techniques of welding contacts or termination devices to conductors of cables are known in the art. Numerous steps are required to perform the welding process. To prepare the weld surface, the insulation must be removed from the conductor. The surface of the conductor must be cleaned and prepared for welding. The termination device is likewise cleaned and prepared for welding. Then the termination device is welded to the conductor of the cable. Such preparation and assembly of parts is time consuming and labor intensive and, hence, is costly. Additionally, when conductors of the cable are placed close together, the welding process becomes even more difficult.

FIGS. 1–5 disclose related art cables and termination devices. FIG. 1 is a perspective view showing a flat cable 10 having flat conductors 12, where the flat conductors 12 are covered with an insulating layer or sheath 14. FIG. 2 is an end view of the flat cable 10 showing ends of the flat conductors 12 covered by the insulating layer 14. FIG. 2 further shows the width X of one of the flat conductors 12. The width X is typical of all of the flat conductors 12 shown in FIG. 2.

FIG. 3 is a front view of a typical insulation displacement contact 16.

FIG. 4 is a front view of the IDC of FIG. 3 connected around the conductor 12 and insulation sheath 14. A problem develops in that the conductor does not make adequate electrical connection with the conductor, since the flat conductor 12 buckles, as shown in FIG. 4. The electrical connection between the IDC 16 and the flat conductor 12 would be enhanced if the flat conductor 12 were in a flat, i.e., non-buckled, orientation.

The IDC 16 of FIG. 3 fails for another reason, especially with use of insulation sheathing material 14 made of MYLAR type polyester film. FIG. 5 identifies that, even if the conductor 12 is flat, the insulating layer 14 is not cleanly removed from the side of the conductor 12. Through experimentation, Applicants have found that the insulating layer 14 rides up and is squeezed or wedged between the IDC 16 and the flat conductor 12. Thus, the electrical connection between the flat conductor 12 and the IDC 16 is impaired and is not adequate.

Thus, there is a need for an inexpensive, reliable, small, and easy to assemble termination device for flat conductors of a flat cable.

Furthermore, there is a need for an IDC that provides a clean, intimate contacting surface between the conductor and the IDC. Additionally, there is a need for an IDC which prevents the flat conductor from buckling and which prevents the insulating layer from being wedged between the IDC and the flat conductor of the flat cable.

SUMMARY OF THE INVENTION

Therefore, it is an object of the present invention to provide an insulation displacement contact that effectively makes electrical contact with a flat conductor of a flat cable, while being inexpensive.

Yet another object of the invention is to provide a termination or interconnection device and method for terminating or interconnecting to flat conductors of a flat cable anywhere along the length of the flat cable which is easy to use and which is reliable.

It is a further object of the invention to provide a single IDC which can electrically connect two flat conductors, where each of the two flat conductors belongs to a different flat cable.

Another object of the invention is to prevent the flat conductor of the flat cable from buckling when it is being electrically connected to an IDC.

Still another object of the invention is to prevent the insulating layer of the flat cable from being wedged between the tines of the IDC and the flat conductor during the displacement of insulation.

In one form of the invention, the insulation displacement contact is used for connecting itself to a flat conductor of a flat cable. The insulation displacement contact includes a base, a first tine connected to the base and a second tine connected to the base. The first tine having a first edge and a second edge. The first edge being adjacent to a free end, where the free end has a first knife edge. The second tine having a third edge and a fourth edge. The third edge being adjacent to a free end, where the free end has a knife edge. The third edge of the second tine opposes the first edge of the first tine. The first edge of the first tine being separated from the third edge of the second tine by a first distance. The fourth edge of the second tine opposes the second edge of the first tine. The second edge of the first tine being separated from the fourth edge of the second tine by a second distance. The first distance being greater than the second distance.

In another embodiment, the invention described above includes an upper support surface positioned between the first tine and the second tine so as to urge the conductor towards the base.

In another embodiment of the invention, a method of displacing the insulation of a flat cable is set forth for exposing the flat conductor of the flat cable. The IDC of the invention as described above is used to perform a step of displacing the insulation layer of the flat cable. Then, the insulation displacement contact performs a step of electrically contacting the flat conductor of the flat cable. Furthermore, a step can be provided of positioning a back-up element between the flat conductor and the base of the insulation displacement contact. An additional step includes physically contacting a portion of the flat cable positioned between the first and second tines of the insulation displacement contact with an upper support surface. Another step can be provided which includes the step of urging the upper support surface toward the base of the insulation displacement contact so as to position the exposed portion of the flat conductor between the first and second tines where the first and second tines are separated by the second distance so as to prevent the flat conductor from buckling.

In yet another embodiment of the invention, a method of connecting a flat conductor of a flat cable with an insulation displacement contact includes the steps of placing the flat cable on a block housing, installing an upper mounting block on top of the flat cable so as to trap the flat cable between the block housing and the upper mounting block, securing the upper mounting block to the block housing, and pushing the insulation displacement contact into the flat cable so as to make electrical contact with the flat conductor.

In another embodiment the invention takes the form of a terminated cable assembly. The terminated cable assembly includes a cable having a conductor. The cable is received in a housing. On one side of the cable is mounted a back-up element, on another side of the cable is mounted an upper support surface. Within the housing are positioned insulation displacement contacts. At least one insulation displacement contact being mounted within the cable making an electrical connection to the conductor, and a portion of the insulation displacement contact abutting the back-up element so as to contain a portion of the conductor between the back-up element and the upper support surface wherein the terminated cable assembly avoids buckling of the conductor or deterioration of the connection to the conductor. Any shaped cable may be used, including cables having a cross-sectional shape that is flat or circular. Also, any shaped conductor can be used, including conductors having a cross-sectional shape that is flat or circular.

Thus, the invention is superior to the prior art. The invention provides an insulation displacement contact which cleanly cuts and removes the insulation layer away from the contacting region between the IDC and the conductor. Furthermore, the invention provides an easy to use IDC in an industrial assembly environment, such as in the automobile industry. Therefore, both the ease-of-use of the IDC is increased and the reliability of the IDC is increased as compared to known insulation displacement contacts. These and other features of the invention are set forth below in the following detailed description of the presently preferred embodiment.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PRESENTLY PREFERRED EMBODIMENT

Figure 6B:
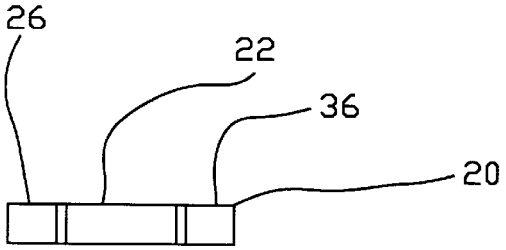
FIG. 6B is a top view of the insulation displacement contact of FIG. 6A.
Figure 6A:
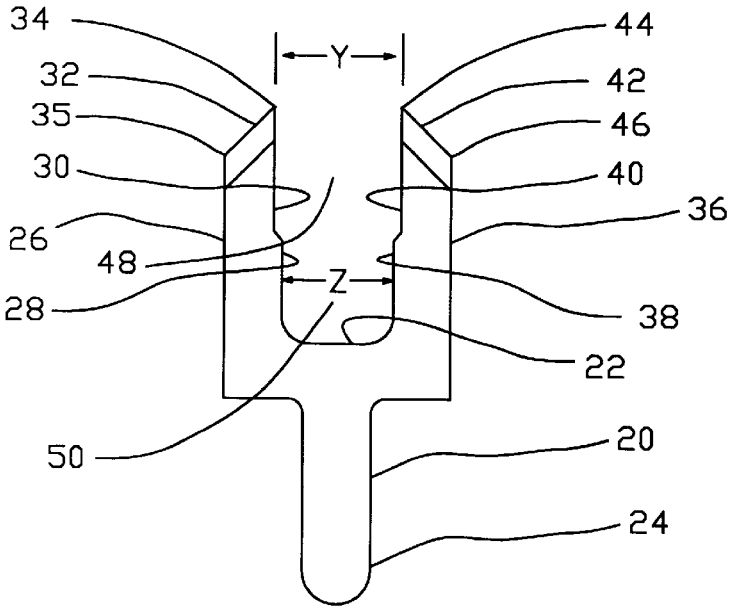
FIG. 6A is a front view of an insulation displacement contact of the present invention.
Figure 6C:
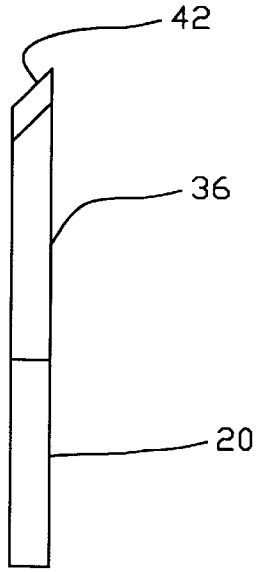
FIG. 6C is a side view of the insulation displacement contact of FIG. 6A.
Figure 7:
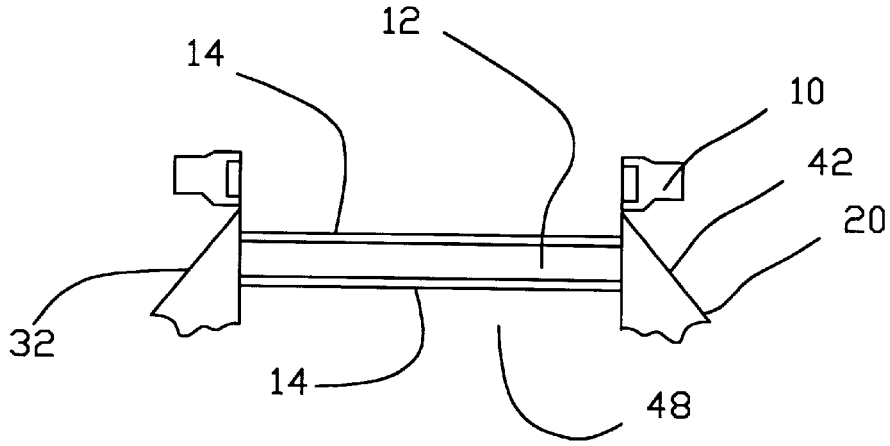
FIG. 7 is a partial front view of the insulation displacement contact of FIG. 6A making contact with a flat conductor of a flat cable.
Figure 8:
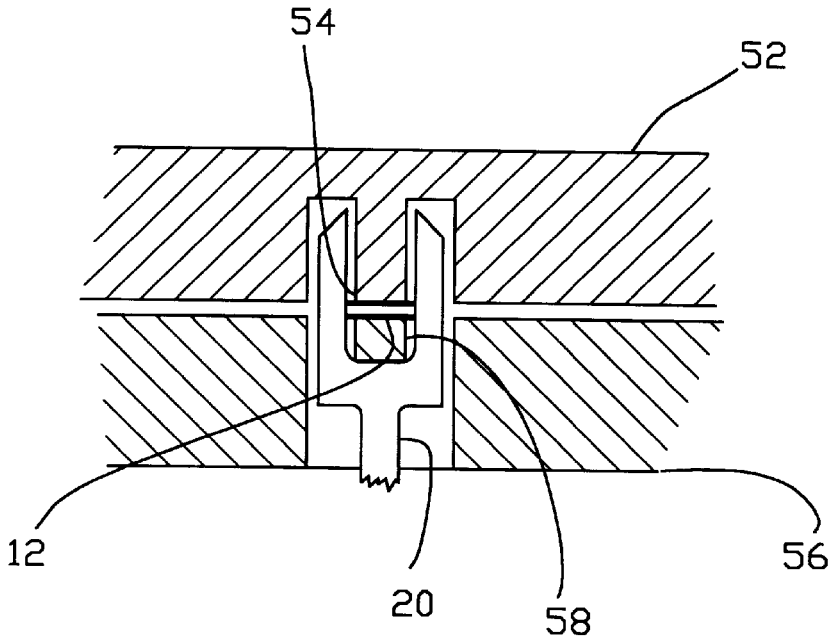
FIG. 8 is a front view of the insulation displacement contact of the invention and of a back-up element retaining the flat conductor of the flat cable.

Referring now to the drawings, wherein like reference numerals designate identical or corresponding parts throughout the several views, and more particularly to FIGS. 6–8 thereof, a first embodiment of the present invention is an insulation displacement contact (IDC) 20 having a base 22, a contact 24, a first tine 26, and a second tine 36, as displayed in FIG. 6A.

FIG. 6A is a front view of the IDC 20. The contact 24 is connected to the base 22 of the IDC 20. The first tine 26 is connected to the base 22. The second tine 36 is also connected to the base 22.

The first tine 26 has a first edge 30 and a second edge 28. The first edge 30 having an end thereof located adjacent to a free end 32 of the first tine 26. The second edge 28 having an end thereof located adjacent to the base 22. The first edge 30 having another end located adjacent to another end of the second edge 28. The free end 32 includes a knife edge. The knife edge of the first tine 26 extends from a first point 34 to a second point 35 along the free end 32. The first point 34 being positioned further away from the base 22 than is the second point 35. The second point 35 being positioned further away from the second tine 36 than is the first point 34.

The second tine 36 has a third edge 40 and a fourth edge 38. The third edge 40 having an end thereof located adjacent to a free end 42 of the second tine 36. The fourth edge 38 having an end thereof located adjacent to the base 22. The third edge 40 having another end located adjacent to another end of the fourth edge 38. The free end 42 includes a knife edge. The knife edge of the second tine 36 extends from a third point 44 to a fourth point 46 along the free end 42. The third point being positioned further away from the base 22 than is the fourth point 46. The fourth point 46 being positioned further away from the first tine 26 than is the third point 44.

Figure 1:
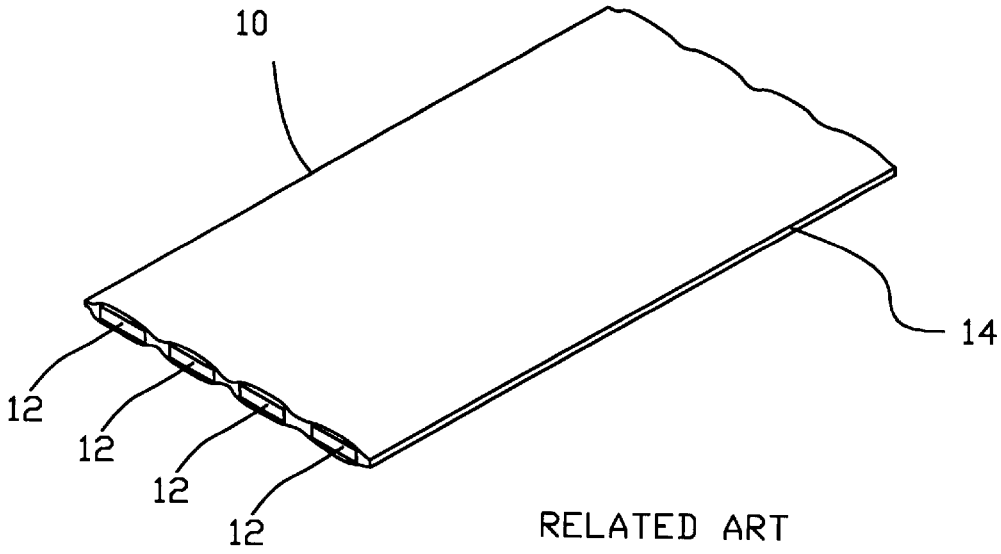
FIG. 1 is a perspective view of a flat cable with four flat conductors contained therein.
Figure 2:
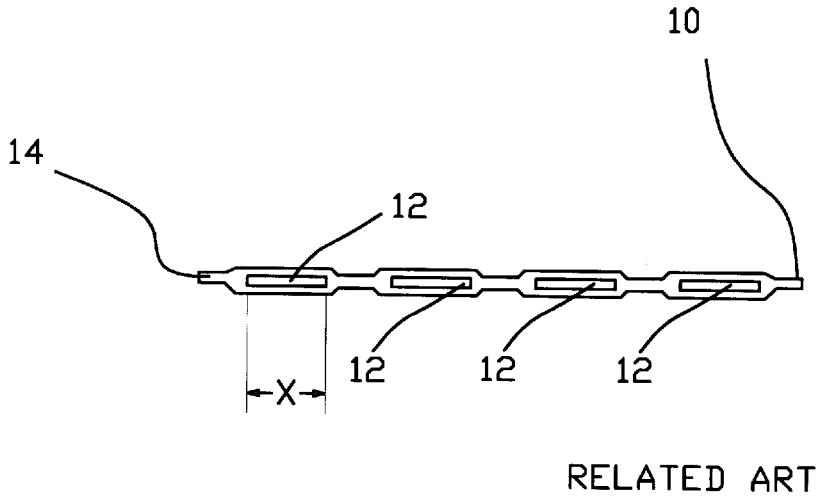
FIG. 2 is an end view of the flat cable of FIG. 1.

The first tine 26 opposes the second tine 36. The first edge 30 of the first tine 26 is separated from the third edge 40 of the second tine 36 by a first distance Y creating a first open area 48. The second edge 28 of the first tine 26 is separated from the fourth edge 38 of the second tine 36 by a second distance Z creating a second open area 50. As shown in FIG. 6A, the first distance Y is greater than the second distance Z. The first distance Y being greater than ninety percent of the width dimension X of a flat conductor, as shown in FIG. 2. Preferably, the first distance Y is approximately equal to ninety-five percent of the width dimension X of the flat conductor. The second distance Z being greater than eighty-five percent of the width dimension X of the flat conductor. Also, preferably, the second distance Z is approximately equal to ninety percent of the width dimension X of the flat conductor, as shown in FIG. 2.

FIG. 6B is a top view of the IDC 20. FIG. 6B shows the base 22 and the first and second tines 26 and 36.

FIG. 6C is a side view of the IDC 20. FIG. 6C shows the contact 20 and the free end 42 of the second tine 36.

The IDC 20 is constructed of an electrically conductive material. The material of construction and geometry of the IDC 20 are such that the IDC 20 is substantially rigid as compared to the flat conductor 12 and the insulating layer 14. Such materials are commonly used in industry, and include copper alloy, steel, aluminum or any other suitable material. The IDC 20 can be manufactured by being ground from a piece of metal, or it can be stamped or forged from a piece of metal, or it can be cast molded from molten metal, or it can be constructed by any other suitable means.

The dimensions of the first and second tines 26 and 36 of the IDC 20 are such that they straddle and cut into the flat conductor 12 and insulating layer 14 of the flat cable 10. However, the first and second tines 26 and 36 of the IDC 20 are so dimensioned so that the IDC 20 contacting one flat conductor does not contact adjacent flat conductors of the flat cable.

Figure 3:
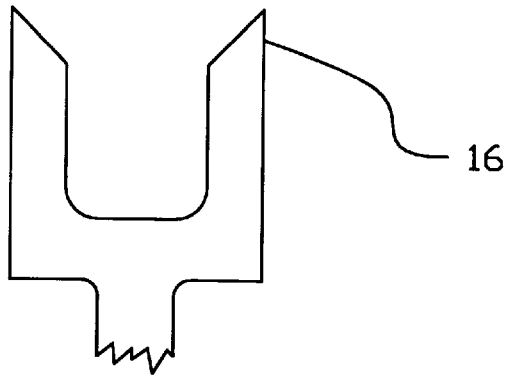
RELATED ART Fig. 3
FIG. 3 is a front view of a conventional insulation displacement contact.

FIG. 7 is a partial side view of the IDC 20 cutting into a flat conductor 12 and the insulation layer 14 of a flat cable 10. The free ends 32 and 42 have their knife edges slanting in a direction opposite to that of the prior art, where the free ends of the prior art IDCs shown in FIGS. 3–5 have their free ends sloping inward. In stark contrast, the invention has the free ends sloping in an outward direction. When the flat cable 10 contacts the IDC 20 a portion of the insulation layer 14 and a portion of the flat conductor 12 are cut away so as to avoid the problems identified in regard to FIG. 5. The IDC 20 removes any of the insulation layer 14 that would be wedged between the IDC 20 and the conductor 12 so as to ensure adequate electrical contact between the two. As the conductor 12 enters the IDC 20 it first passes into the first open area 48, which has the first and second tines 26 and 36 separated by the first distance Y.

Figure 4:
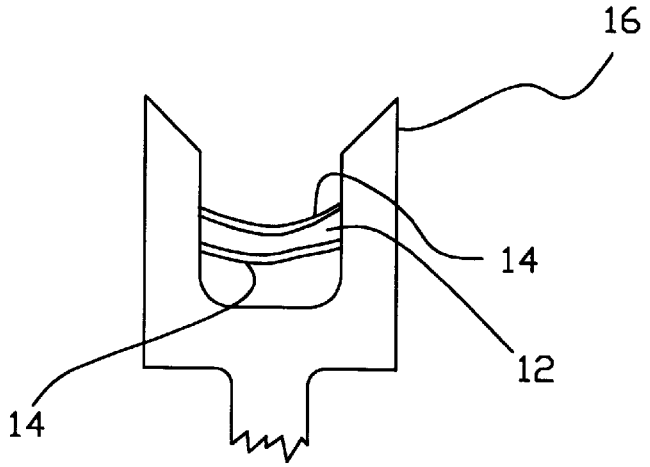
RELATED ART Fig. 4
FIG. 4 is a front view of the conventional insulation displacement contact of FIG. 3 contacting a flat conductor.
Figure 5:
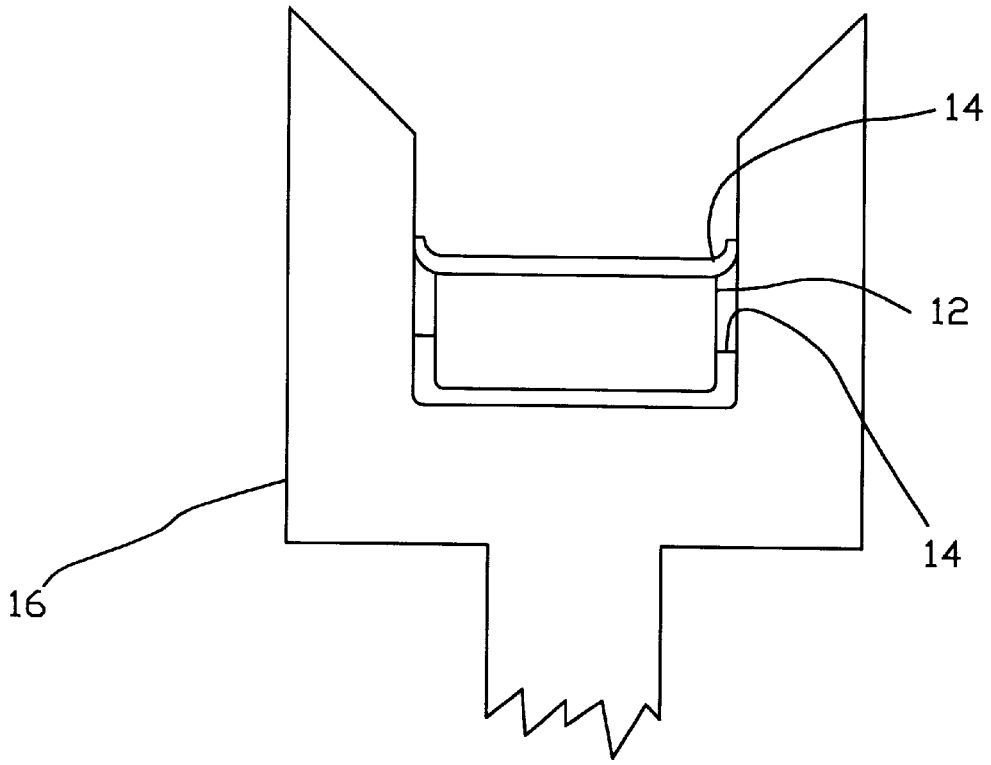
RELATED ART Fig. 5
FIG. 5 is a front view of the insulation displacement contact of FIG. 4 cutting into the insulation of a flat cable.

FIG. 8 is a front view of the IDC 20 positioned within a lower mounting block 56 which includes a back-up element 58 positioned between the first and second tines of the IDC 20. The flat conductor 12 is shown to be trapped between an upper support surface 54 of the upper mounting block 52 and the back-up element 58. The back-up element 58 and the upper support surface 54 ensure that the conductor 12 does not buckle, as shown in FIG. 4. Thus, the device ensures that the flat conductor 12 is in adequate electrical contact with the IDC 20. In such a position, the width of the flat conductor 12 is in a state of compression between the first and second tines of the IDC. For purposes of discussion, FIG. 8 does not perceptibly show the different edges of the tines of the IDC 20 as were shown in FIGS. 6A–6C.

Figure 9A:
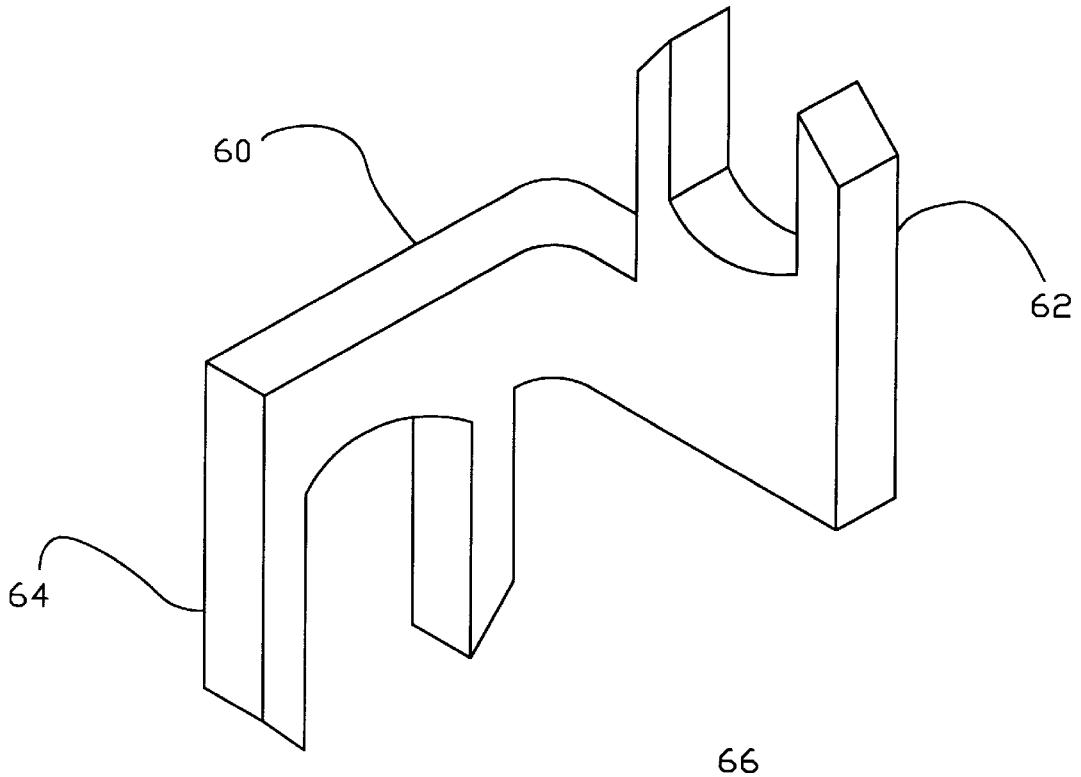
FIGS. 9A and 9B are perspective views of an insulation displacement contact of the present invention making contact with two flat conductors situated at right angles.
Figure 9B:
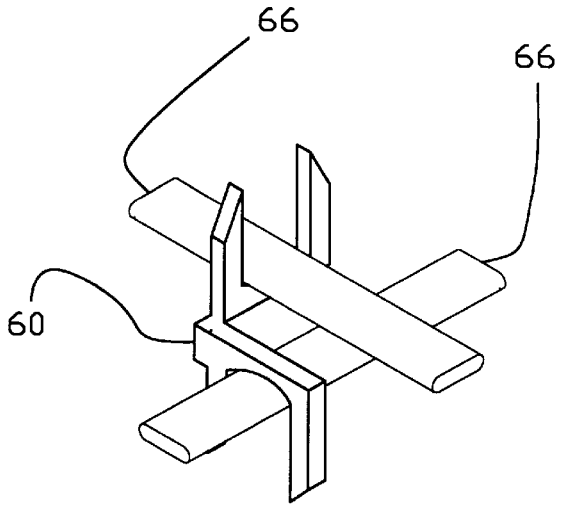

FIG. 9A shows another embodiment of the invention where the IDC 60 has a first end 62 and a second end 64. The first end 62 used for making an electrical connection with a flat conductor of a flat cable and the second end 64 used for making an electrical connection with a different flat conductor of a different flat cable. The IDC 60 therefore makes an electrical connection between two different flat conductors of two different flat cables. FIG. 9B shows the IDC 60 making contact with conductors 66, 66 (the insulating layer 14 is not shown). The tines of the ends 62 and 64 are made in accordance with the tines as shown in FIGS. 6A–6C, however, for discussion purposes the various edge elevations are not shown.

Figure 10:
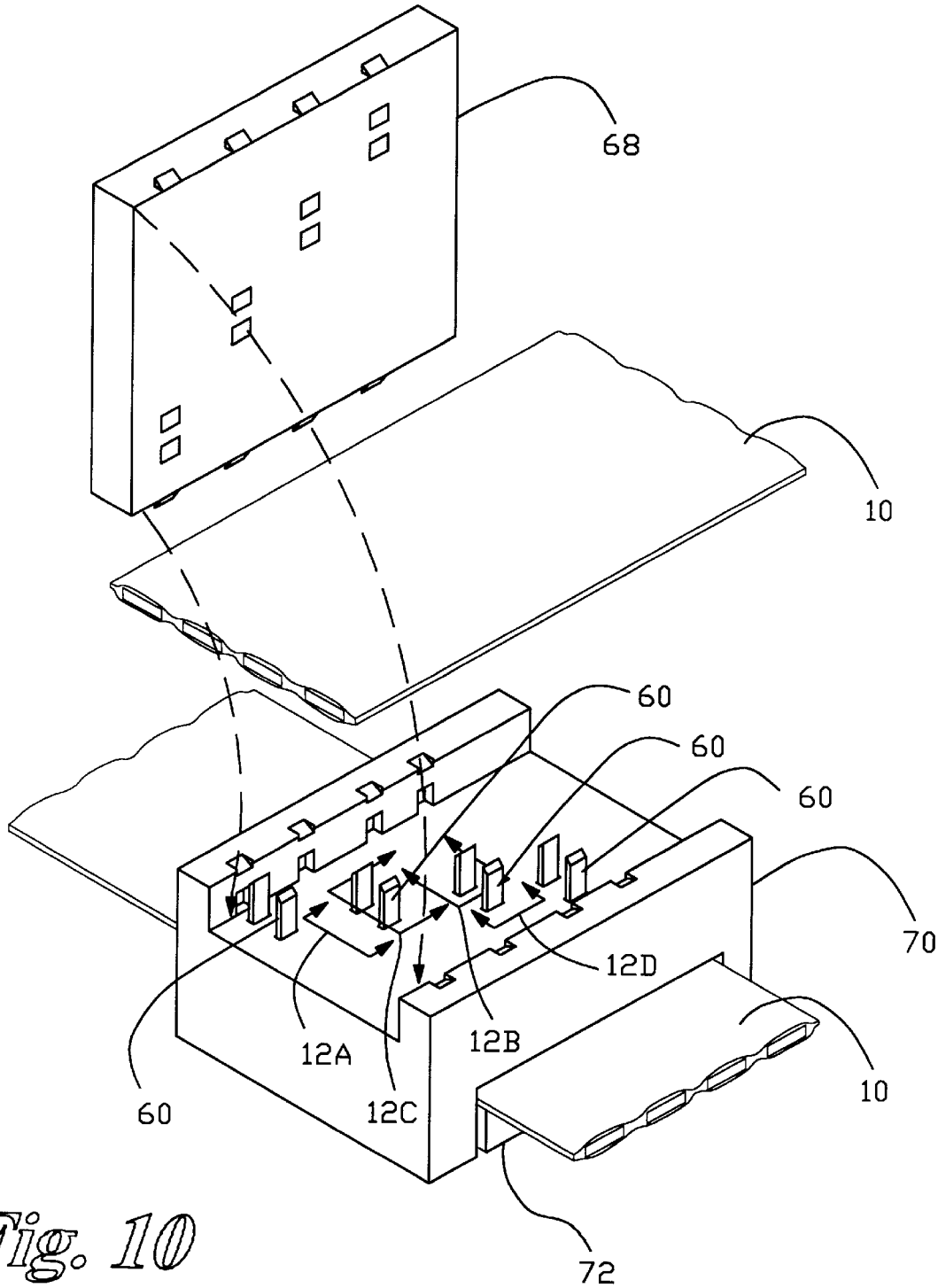
FIG. 10 is a perspective view of the invention connecting two flat cables at a right angle.

A contact such as IDC 60 or 20 can be placed in a mold so as to position the IDCs relative to the flat cables. FIG. 10 is a perspective view of block housing 70 which houses the IDCs 60. FIG. 10 also shows one flat cable 10 positioned in the block housing 70 and secured by an upper mounting block 72 and another flat cable 10 about to be positioned in the block housing 70 and trapped by a lower mounting block 68. Once the flat cable 10 is positioned within the block housing 70, the IDCs 60 cut into the conductors and make electrical contact. The upper and lower mounting blocks 68 and 72 are pushed against the block housing 70 to ensure that the conductors do not buckle. Holes are provided in the upper and lower mounting blocks 68 and 72 so as to accommodate the tines of the IDCs.

Figure 11:
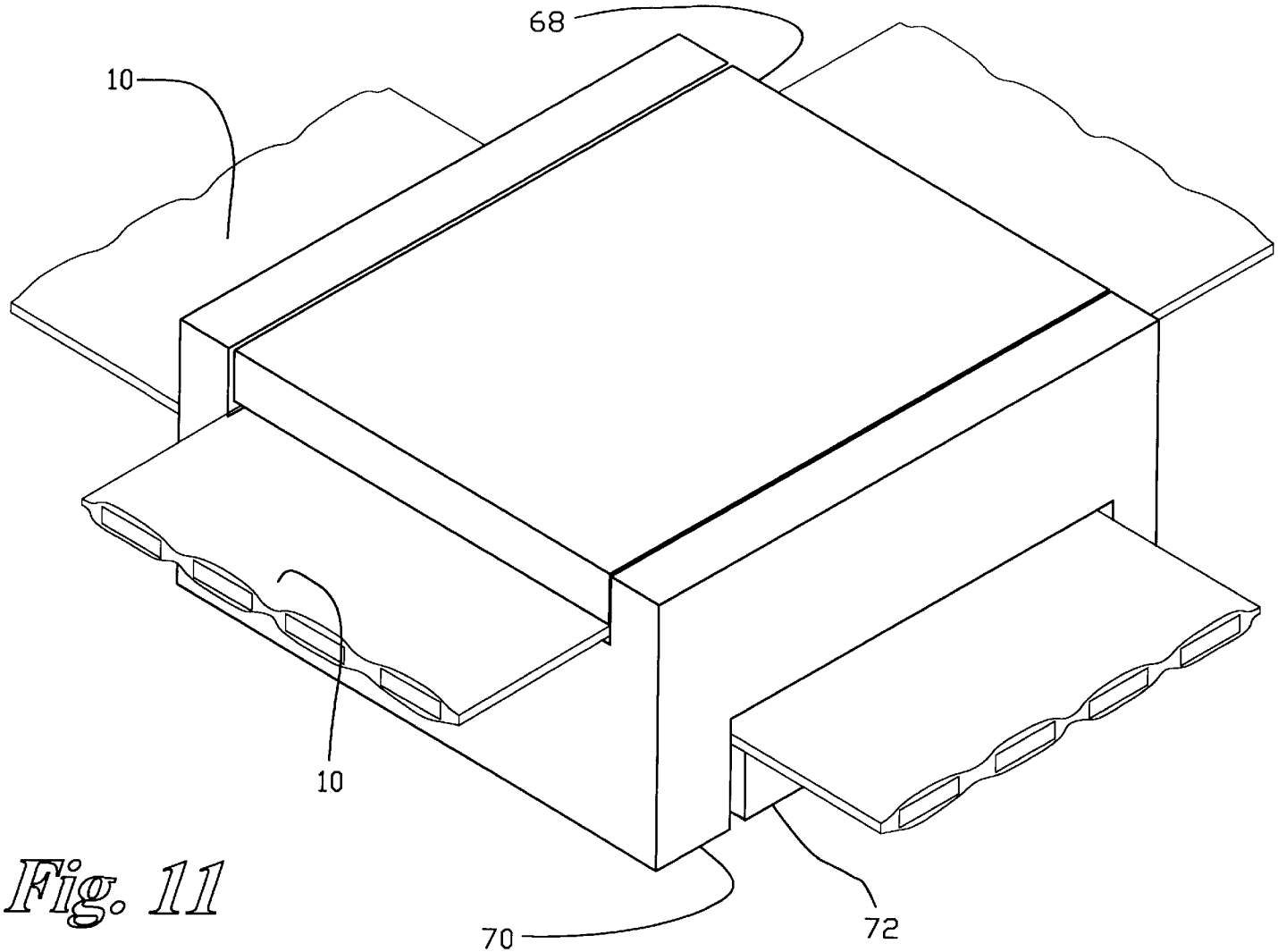
FIG. 11 is a perspective view of the invention as set forth in FIG. 10 in an assembled position.

FIG. 11 is a perspective view showing the completed assembly. The block housing 70 and the upper and lower mounting blocks 68 and 72 along with the IDCs 60 provide a convenient way to make an electrical connection between two skewed flat cables. The flat cables 10 need merely be placed in the appropriate location of the block housing 70 and then the upper and lower mounting blocks fit over the flat cables and snap into place.

Figure 12B:
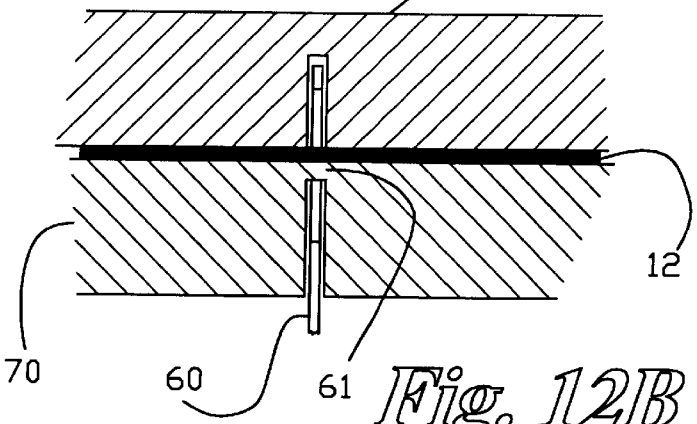
FIGS. 12A, 12B, 12C, and 12D are cross-sectional views taken along section lines 12A—12A, 12B—12B, 12C—12C, and 12D—12D, respectively, as shown in FIG. 10.
Figure 12D:
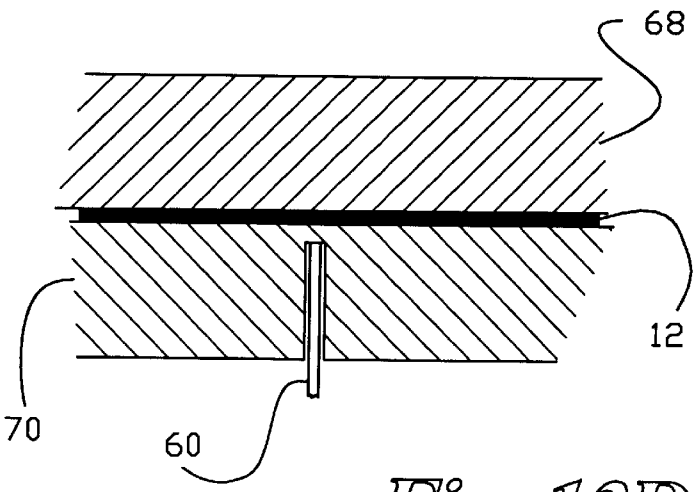
Figure 12C:
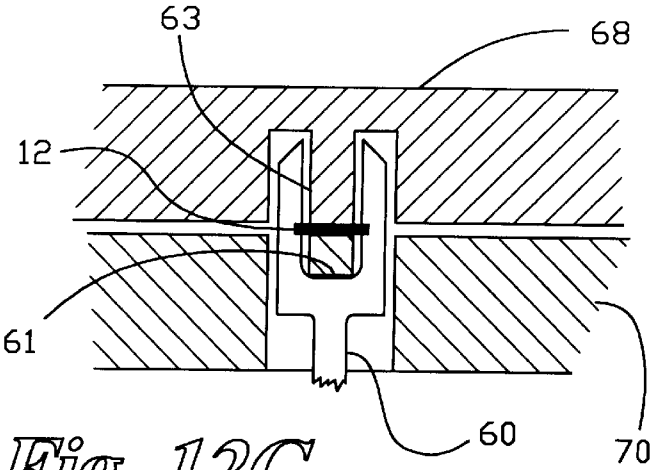
Figure 12A:
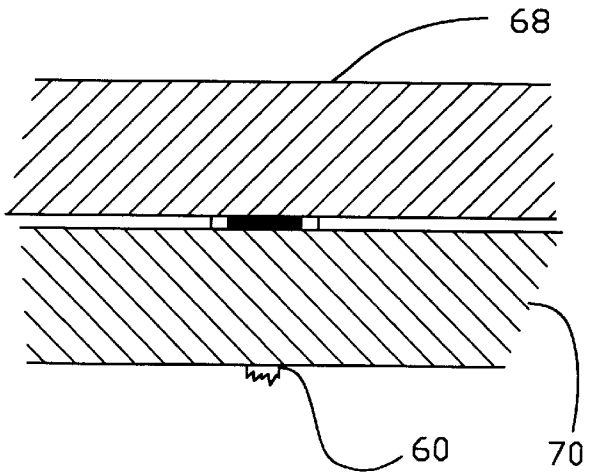

FIGS. 12A, 12B, 12C, and 12D are cross-sectional side views taken along section lines 12A—12A, 12B—12B, 12C—12C, and 12D—12D, respectively, as shown in FIG. 10. FIG. 12C shows a portion of the IDC 60 located in the block housing 70. The IDC 60 connects to the flat conductor and the flat conductor is prevented from buckling by urging the support surface 63 of the upper mounting block 68 toward the base of the IDC 60. The flat conductor 12 being trapped between the support surface 63 and the back-up element 61. Therefore, the flat conductor is kept in a state of compression across its width due to the spacing of the first and second tines being less than the width of the conductor. Thus, adequate electrical connection is achieved between the IDC and the flat conductor. FIG. 12B shows the back-up element 61 being integral with the block housing 70. FIG. 12A shows the positioning of the IDC within the block housing 70 and the upper mounting block 68. FIG. 12D shows the location of the IDC in the block housing 70.

Figure 13A:
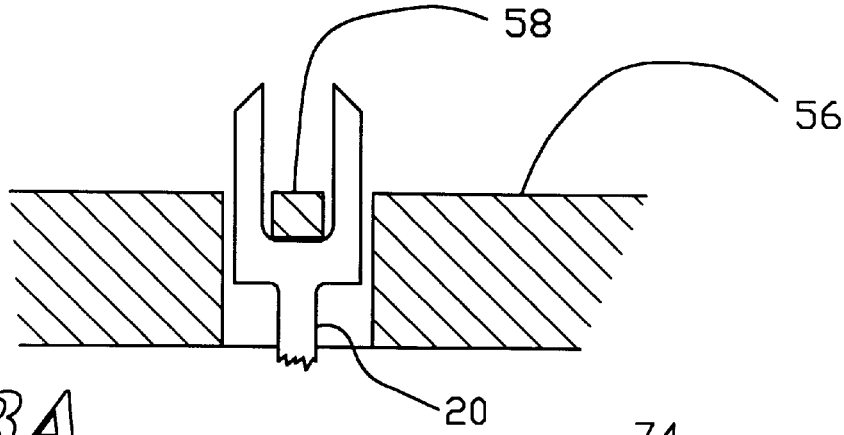
FIGS. 13A, 13B, and 13C are front views showing various methods of providing back-up elements to support one side of a flat conductor.
Figure 13B:
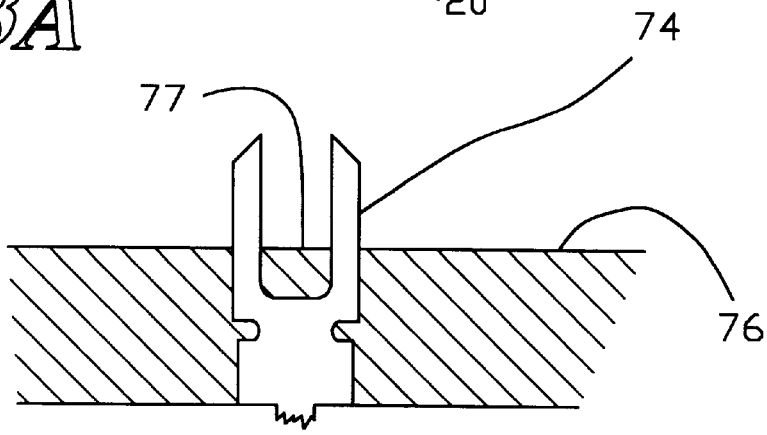
Figure 13C:
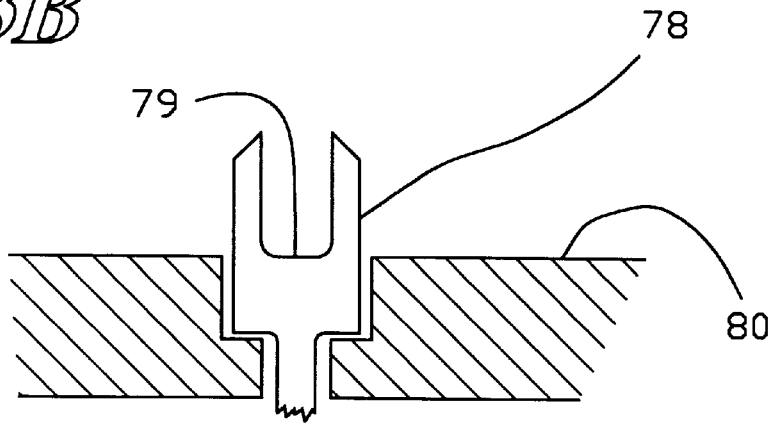

FIGS. 13A, 13B, and 13C are front views showing different ways of providing back-up or support element 58 near the base of the IDC. FIG. 13A shows the IDC 20 rear loaded into the lower mounting block 56. The IDC 20 straddles the back-up element 58 upon insertion into the block housing 56. The back-up element 58 is integral to the block housing 56. The back-up element 58 connects to the block housing 56 at location into and out of the plane of the FIG. 13A. FIG. 13B shows an IDC 74 insert molded into a block housing 76. In FIG. 13B the molding material of the block housing is flowed around the IDC 74, thus securing the IDC 74 to the block housing 76, and, thus, forms the back-up element 77. FIG. 13C shows an IDC 78 top loaded into a block housing 80. In FIG. 13C the IDC 78 is placed into the access aperture provided in the block housing 80. The IDC 78 has a base 79 which performs the function of the back-up element.

The IDC of the invention can be attached to or formed with known termination configurations. Such termination configurations attached to the IDC are shown in FIGS. 14A–14F. The tines of the IDCs shown in FIGS. 14A–14F are constructed based on the tines of IDC 20 shown in FIGS. 6A–6C, however, FIGS. 14A–14F do not illustrate the various edges of the tines.

Figure 14A:
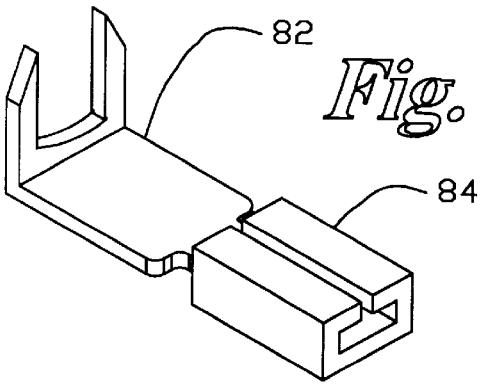
FIGS. 14A, 14B, 14C, 14D, 14E, and 14F are various perspective views of insulation displacement contacts of the present invention.

FIG. 14A is a perspective view of an IDC 82 according to the invention and includes an in-line female box contact 84.

Figure 14B:
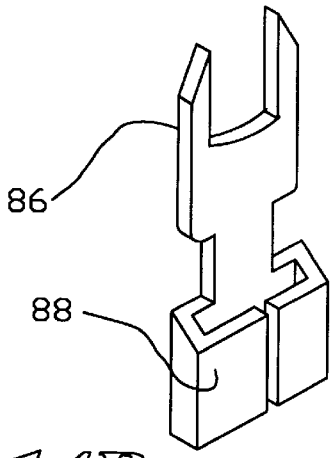

FIG. 14B is a perspective view of an IDC 86 according to the invention including a right angle female box contact 88.

Figure 14C:
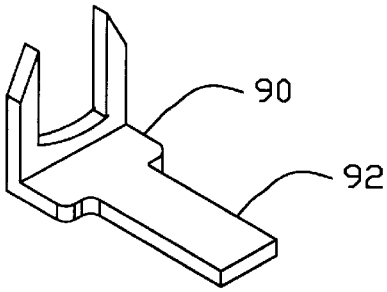

FIG. 14C is a perspective view of an IDC 94 according to the invention including an in-line male pin.

Figure 14D:
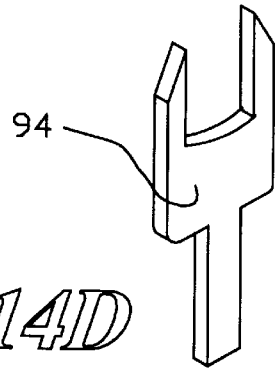

FIG. 14D is a perspective view of an IDC 90 according to the invention including a right angle male pin 92.

Figure 14E:
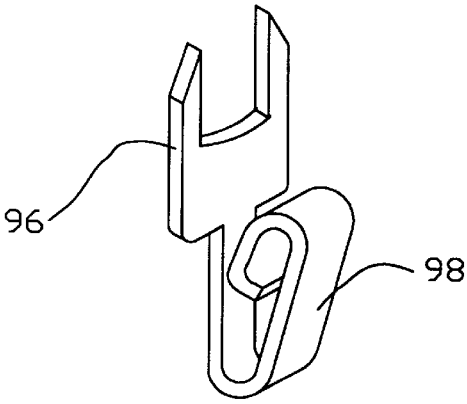

FIG. 14E is a perspective view of an IDC 100 according to the invention including a right angle bellows contact 102.

Figure 14F:
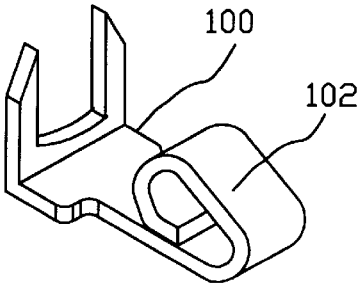

FIG. 14F is a perspective view of an IDC 96 according to the invention including an in-line bellows contact 98.

Other embodiments of the invention provide for electrical connection between flat conductors and circular conductors. FIGS. 15A–15D display such embodiments. The flat conductor IDCs shown in FIGS. 15A–15D are manufactured according to the invention as shown in FIG. 6A. However, the tines of the IDCs shown in FIGS. 15A–15D do not illustrate the various edges of the tines as are illustrated in FIGS. 6A–6C.

Figure 15A:
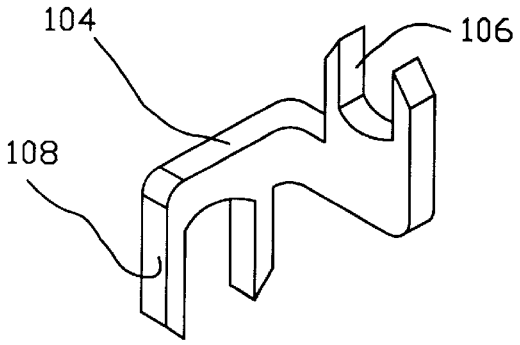
FIGS. 15A, 15B, 15C, and 15D are perspective views of various insulation displacement contacts according to the invention.

FIG. 15A is a perspective view of a cable-to-cable cross connector 104. The cable-to-cable cross connector 104 has a first IDC 106 for connecting to a flat conductor and a second IDC 108 for connecting to a second flat conductor oriented ninety degrees to the first flat conductor.

Figure 15B:
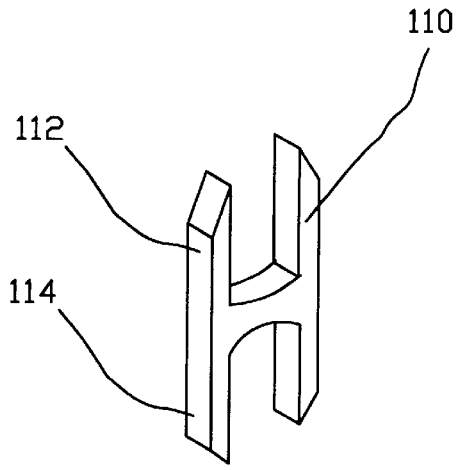

FIG. 15B is a perspective view of a cable-to-cable in-line connector 110. The cable-to-cable in-line connector 110 has a first IDC 112 and a second IDC 114. The first IDC 112 connects to a first flat conductor and the second IDC 114 connects to a second flat conductor, where the second flat conductor is parallel or in-line with the first flat conductor.

Figure 15C:
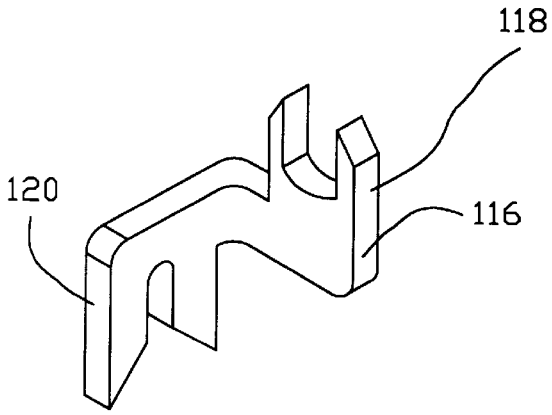

FIG. 15C is a perspective view of a cable-to-wire cross connector 116. The cable-to-wire cross connector 116 has a first IDC 118 and a second IDC 120. The first IDC 118 connects to a flat conductor and the second IDC 120 connects to a wire having a round or circular cross-section, where the wire is oriented ninety degrees to the flat conductor. The second IDC 120 is preferably manufactured in accordance with known shapes and techniques.

Figure 15D:
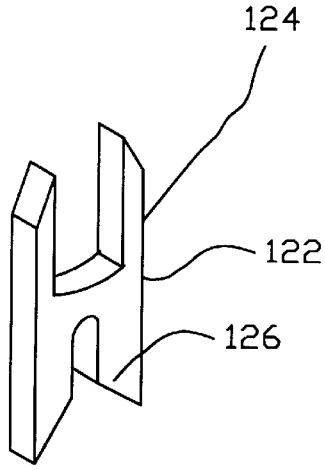

FIG. 15D is a perspective view of a cable-to-wire in-line connector 122. The cable-to-wire in-line connector 122 has a first IDC 124 and a second IDC 126. The first IDC 124 connects to a flat conductor and the second IDC 126 connects to a wire having a round or circular cross section, where the wire is parallel or in-line with the flat conductor. The second IDC 126 is preferably manufactured in accordance with known shapes and techniques.

Figure 16:
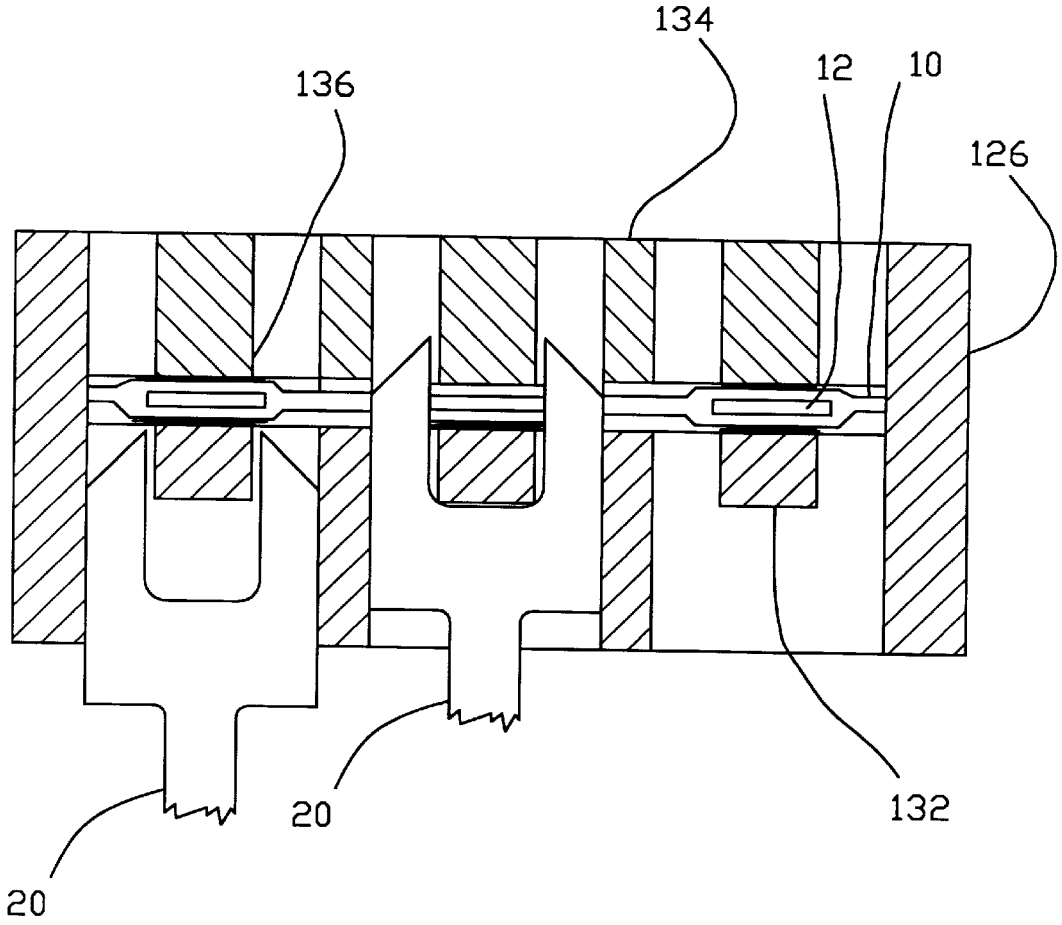
FIG. 16 is a partial, front, cross-sectional view of an IDC splicing into a flat conductor of a flat cable.

FIG. 16 is a partial, front, cross-sectional view of an IDC 20, an upper mounting block 134, a block housing 130, and a flat cable 10, where the cross-section is similar to those shown in associated FIGS. 8 and 10–12, which show an IDC in a block housing. FIG. 16 shows another method of making an electrical connection between the flat conductor 12 of the flat cable 10 and the IDC 20. The insulation displacement contact 20 is that as shown in FIGS. 6A–6C. The upper mounting block 134 includes an upper support surface 136. The block housing 130 has a back-up element 132. The presently discussed upper support surfaces and back-up elements have the same purpose as those described in earlier embodiments and will not be discussed further.

FIG. 16 shows, at the far right of the figure, a location where no IDC has been introduced. At the far left of FIG. 16 is illustrated an IDC 20 being introduced into the block housing 130. The middle portion of FIG. 16 shows an IDC 20 pierced through the flat conductor 12 of the flat cable 10, thus, making electrical contact between the flat conductor 12 and the IDC 20. The IDC 20 at the middle location of FIG. 16 is in contact with the back-up element 132 of the block housing 130. The portion of the flat cable 10 opposite to the back-up element 132 is in contact with the upper support surface 136 of the upper mounting block 134.

The steps include placing the flat cable 10 on the block housing 130. The next step includes installing the upper mounting block 134 on top of the flat cable so as to trap the flat cable 10 between the block housing 130 and the upper mounting block 134. The upper mounting block 134 can be secured to the block housing 130 via snaps or other attachment means (not shown). Then, the next step includes pushing the insulation displacement 20 contact into the flat cable 10 so as to make electrical contact between the insulation displacement contact 20 and the flat conductor 12 of the flat cable 10.

Obviously, numerous modifications and variations of the present invention are possible in light of the above teachings. It is therefore to be understood that within the scope of the appended claims, the invention may be practiced otherwise than as specifically described herein.

What is claimed is:

1. An insulation displacement contact for connecting to a flat conductor of a flat cable, the flat conductor having a width dimension and a thickness dimension, the width dimension being greater than the thickness dimension, the insulation displacement contact comprising:

a base;

a first tine connected to the base, the first tine having a first edge and a second edge, the first edge being adjacent to a free end of the first tine and the second edge being adjacent to the base, wherein the free end has a first knife edge; and a second tine connected to the base, the second tine having a third edge and a fourth edge, the third edge being adjacent to a free end of the second tine and the fourth edge being adjacent to the base, wherein the free end has a second knife edge, and wherein the first edge of the first tine opposes the third edge of the second tine, and the first edge of the first tine being separated from the third edge of the second tine by a first distance, and wherein the second edge of the first tine opposes the fourth edge of the second tine, and the second edge of the first tine being separated from the fourth edge of the second tine by a second distance, and wherein the first distance being greater than the second distance, and wherein the first knife edge extends from a first point to a second point along the free end of the first tine, the first point located adjacent to the first edge of the first tine, the first point positioned further away from the base than is the second point, and the second point positioned further away from the second tine than is the first point and wherein the second knife edge extends from a third point to a fourth point along the free end of the second tine, the third point located adjacent to the third edge of the second tine, the third point positioned further away from the base than is the fourth point, and the fourth point positioned further away from the first tine than is the third point.

2. An insulation displacement contact according to claim 1, further comprising a contact connected to the base.

3. An insulation displacement contact according to claim 2, further comprising an upper support surface positioned between the first tine and the second tine so as to urge the flat conductor toward the base.

4. An insulation displacement contact according to claim 3 wherein the first distance being less than the width of the flat conductor.

5. An insulation displacement contact according to claim 4 wherein the first distance being greater than ninety percent of the width of the flat conductor.

6. An insulation displacement contact according to claim 4 wherein the second distance being greater than eighty-five percent of the width of the flat conductor.

7. An insulation displacement contact according to claim 1 wherein the insulation displacement contact has only the first tine and the second tine.

8. An insulation displacement contact according to claim 3, further comprising a back-up element positioned between the flat conductor and the base.

9. A method of terminating a flat conductor of a flat cable with an insulation displacement contact, where the insulation displacement contact has a first tine and a second tine both of which are connected to a base of the insulation displacement contact, the first tine having first and second edges, the second edge located near the base, the first edge located adjacent to the second edge and also to a free end of the first tine, the free end of the first tine has a first knife edge, the second tine having third and fourth edges, the fourth edge located near the base, the third edge located adjacent the fourth edge and also being located adjacent a free end of the second tine, the free end of the second tine has a second knife edge, the first edge and the third edge oppose each other, the first edge and the third edge separated by a first distance, the second edge and the fourth edge oppose each other, the second edge and the fourth edge separated by a second distance, the first distance being greater than the second distance, and wherein the first knife edge extends from a first point to a second point along the free end of the first tine, the first point located adjacent to the first edge of the first tine, the first point positioned further away from the base than is the second point, and the second point positioned further away from the second tine than is the first point, and wherein the second knife edge extends from a third point to a fourth point along the free end of the second tine, the third point located adjacent to the third edge of the second tine, the third point positioned further away from the base than is the fourth point, and the fourth point positioned further away from the first tine than is the third point, the method comprising the steps of:

displacing an insulation layer of the flat cable which surrounds the flat conductor housed therein with the insulation displacement contact so as to expose a portion of the flat conductor; and electrically contacting the flat conductor of the flat cable with the insulation displacement contact.

10. A method according to claim 9, further comprising the step of physically contacting a portion of the flat cable positioned between the first and second tines of the insulation displacement contact with an upper support surface.

11. A method according to claim 10, further comprising the step of urging the upper support surface toward the base of the insulation displacement contact so as to position the exposed portion of the flat conductor between the first and second tines where the first and second tines are separated by the second distance so as to prevent the flat conductor from buckling.

12. A method according to claim 11, further comprising the step of positioning a back-up element between the base of the insulation displacement contact and the flat conductor.

13. The method according to claim 9 wherein the insulation layer is made of a polyester material.

14. A method of connecting a flat conductor of a flat cable with an insulation displacement contact, where the insulation displacement contact has a first tine and a second tine both of which are connected to a base of the insulation displacement contact, the first tine having first and second edges, the second edge located near the base, the first edge located adjacent to the second edge and also to a free end of the first tine, the free end of the first tine has a first knife edge, the second tine having third and fourth edges, the fourth edge located near the base, the third edge located adjacent the fourth edge and also being located adjacent a free end of the second tine, the free end of the second tine has a second knife edge, the first edge and the third edge oppose each other, the first edge and the third edge separated by a first distance, the second edge and the fourth edge oppose each other, the second edge and the fourth edge separated by a second distance, the first distance being greater than the second distance, and wherein the first knife edge extends from a first point to a second point along the free end of the first tine, the first point located adjacent to the first edge of the first tine, the first point positioned further away from the base than is the second point, and the second point positioned further away from the second tine than is the first point, and wherein the second knife edge extends from a third point to a fourth point along the free end of the second tine, the third point located adjacent to the third edge of the second tine, the third point positioned further away from the base than is the fourth point, and the fourth point positioned further away from the first tine than is the third point, the method comprising the steps of:

placing the flat cable on a block housing;

installing an upper mounting block on top of the flat cable so as to trap the flat cable between the block housing and the upper mounting block; and pushing the insulation displacement contact into the flat cable so as to make electrical contact between the insulation displacement contact and the flat conductor of the flat cable.

15. A method according to claim 14, further comprising the step of securing the upper mounting block to the block housing.

16. A terminated cable assembly comprising:

a cable having a conductor;

a housing for receiving the cable;

a back-up element mounted to the cable;

an upper support surface mounted to the cable;

means for urging the back-up element toward the upper support surface; and an insulation displacement contact mounted in the housing, and wherein the insulation displacement contact being mounted within the cable making an electrical connection to the conductor, and a portion of the insulation displacement contact abutting the back-up element so as to contain a portion of the conductor between the back-up element and the upper support surface wherein the terminated cable assembly avoids buckling of the conductor and deterioration of the electrical connection to the conductor, and wherein the insulation displacement contact includes:

a base, a first tine connected to the base, the first tine having a first edge and a second edge, the first edge being adjacent to a free end of the first tine and the second edge being adjacent to the base, wherein the free end has a first knife edge, and a second tine connected to the base, the second tine having a third edge and a fourth edge, the third edge being adjacent to a free end of the second tine and the fourth edge being adjacent to the base, wherein the free end has a second knife edge, and wherein the first edge of the first tine opposes the third edge of the second tine, and the first edge of the first tine being separated from the third edge of the second tine by a first distance, and wherein the second edge of the first tine opposes the fourth edge of the second tine, and the second edge of the first tine being separated from the fourth edge of the second tine by a second distance, and wherein the first distance being greater than the second distance, and wherein the first knife edge extends from a first point to a second point along the free end of the first tine, the first point located adjacent to the first edge of the first tine, the first point positioned further away from the base than is the second point, and the second point positioned further away from the second tine than is the first point, and wherein the second knife edge extends from a third point to a fourth point along the free end of the second tine, the third point located adjacent to the third edge of the second tine, the third point positioned further away from the base than is the fourth point, and the fourth point positioned further away from the first tine than is the third point.

17. A terminated cable assembly according to claim 16 wherein the cable has a cross-sectional shape that is a flat.

18. A terminated cable assembly according to claim 17 wherein the conductor has a cross-sectional shape that is a flat.

19. An insulation displacement contact assembly for connecting to a flat conductor of a flat cable, the insulation displacement contact assembly comprising:

the flat cable including the flat conductor, the flat conductor having a width dimension and a thickness dimension, the width dimension being greater than the thickness dimension, wherein the flat cable includes insulation layers surrounding the flat conductor, wherein the insulation layers are sonically welded to each other;

a base;

a first tine connected to the base, the first tine having a first edge and a second edge, the first edge being adjacent to a free end of the first tine and the second edge being adjacent to the base, wherein the free end has a first knife edge; and a second tine connected to the base, the second tine having a third edge and a fourth edge, the third edge being adjacent to a free end of the second tine and the fourth edge being adjacent to the base, wherein the free end has a second knife edge, and wherein the first edge of the first tine opposes the third edge of the second tine, and the first edge of the first tine being separated from the third edge of the second tine by a first distance, and wherein the second edge of the first tine opposes the fourth edge of the second tine, and the second edge of the first tine being separated from the fourth edge of the second tine by a second distance, and wherein the first distance being greater than the second distance, and wherein the first knife edge extends from a first point to a second point along the free end of the first tine, the first point located adjacent to the first edge of the first tine, the first point positioned further away from the base than is the second point, and the second point positioned further away from the second tine than is the first point, and wherein the second knife edge extends from a third point to a fourth point along the free end of the second tine, the third point located adjacent to the third edge of the second tine, the third point positioned further away from the base than is the fourth point, and the fourth point positioned further away from the first tine than is the third point, and wherein the first tine and the second tine electrically contact the flat conductor.

20. The insulation displacement contact assembly according to claim 19 wherein the insulation layers are made of a polyester material.

21. The method according to claim 1 wherein the insulation layers are made of a polyester material.

22. The method according to claim 1 wherein the insulation layers are made of a polyester material.

23. The terminated cable assembly according to claim 1 wherein the insulation layers are made of a polyester material.

24. A method of terminating a flat conductor of a flat cable with an insulation displacement contact, where the insulation displacement contact has a first tine and a second tine both of which are connected to a base of the insulation displacement contact, the first tine having first and second edges, the second edge located near the base, the first edge located adjacent to the second edge and also to a free end of the first tine, the free end of the first tine has a first knife edge, the second tine having third and fourth edges, the fourth edge located near the base, the third edge located adjacent the fourth edge and also being located adjacent a free end of the second tine, the free end of the second tine has a second knife edge, the first edge and the third edge oppose each other, the first edge and the third edge separated by a first distance, the second edge and the fourth edge oppose each other, the second edge and the fourth edge separated by a second distance, the first distance being greater than the second distance, and wherein the first knife edge extends from a first point to a second point along the free end of the first tine, the first point located adjacent to the first edge of the first tine, the first point positioned further away from the base than is the second point, and the second point positioned further away from the second tine than is the first point, and wherein the second knife edge extends from a third point to a fourth point along the free end of the second tine, the third point located adjacent to the third edge of the second tine, the third point positioned further away from the base than is the fourth point, and the fourth point positioned further away from the first tine than is the third point, the method comprising the steps of:

sonically welding insulation layers around the flat conductor so as to form the flat cable;

displacing the insulation layers of the flat cable which surrounds the flat conductor housed therein with the insulation displacement contact so as to expose a portion of the flat conductor; and electrically contacting the flat conductor of the flat cable with the insulation displacement contact.

25. A method of connecting a flat conductor of a flat cable with an insulation displacement contact, where the insulation displacement contact has a first tine and a second tine both of which are connected to a base of the insulation displacement contact, the first tine having first and second edges, the second edge located near the base, the first edge located adjacent to the second edge and also to a free end of the first tine, the free end of the first tine has a first knife edge, the second tine having third and fourth edges, the fourth edge located near the base, the third edge located adjacent the fourth edge and also being located adjacent a free end of the second tine, the free end of the second tine has a second knife edge, the first edge and the third edge oppose each other, the first edge and the third edge separated by a first distance, the second edge and the fourth edge oppose each other, the second edge and the fourth edge separated by a second distance, the first distance being greater than the second distance, and wherein the first knife edge extends from a first point to a second point along the free end of the first tine, the first point located adjacent to the first edge of the first tine, the first point positioned further away from the base than is the second point, and the second point positioned further away from the second tine than is the first point, and wherein the second knife edge extends from a third point to a fourth point along the free end of the second tine, the third point located adjacent to the third edge of the second tine, the third point positioned further away from the base than is the fourth point, and the fourth point positioned further away from the first tine than is the third point, the method comprising the steps of:

placing the flat cable on a block housing;

installing an upper mounting block on top of the flat cable so as to trap the flat cable between the block housing and the upper mounting block, wherein the flat cable includes insulation layers surrounding the conductor, wherein the insulation layers are sonically welded to each other; and pushing the insulation displacement contact into the flat cable so as to make electrical contact between the insulation displacement contact and the flat conductor of the flat cable.

26. A terminated cable assembly comprising:

a cable having a conductor, the cable having insulation layers surrounding the conductor, wherein the insulation layers are sonically welded to each other;

a housing for receiving the cable;

a back-up element mounted to the cable;

an upper support surface mounted to the cable;

means for urging the back-up element toward the upper support surface; and an insulation displacement contact mounted in the housing, and wherein the insulation displacement contact being mounted within the cable making an electrical connection to the conductor, and a portion of the insulation displacement contact abutting the back-up element so as to contain a portion of the conductor between the back-up element and the upper support surface wherein the terminated cable assembly avoids buckling of the conductor, and deterioration of the electrical connection to the conductor and wherein the insulation displacement contact includes:

a base, a first tine connected to the base, the first tine having a first edge and a second edge, the first edge being adjacent to a free end of the first tine and the second edge being adjacent to the base, wherein the free end has a first knife edge, and a second tine connected to the base, the second tine having a third edge and a fourth edge, the third edge being adjacent to a free end of the second tine and the fourth edge being adjacent to the base, wherein the free end has a second knife edge, and wherein the first edge of the first tine opposes the third edge of the second tine, and the first edge of the first tine being separated from the third edge of the second tine by a first distance, and wherein the second edge of the first tine opposes the fourth edge of the second tine, and the second edge of the first tine being separated from the fourth edge of the second tine by a second distance, and wherein the first distance being greater than the second distance, and wherein the first knife edge extends from a first point to a second point along the free end of the first tine, the first point located adjacent to the first edge of the first tine, the first point positioned further away from the base than is the second point, and the second point positioned further away from the second tine than is the first point, and wherein the second knife edge extends from a third point to a fourth point along the free end of the second tine, the third point located adjacent to the third edge of the second tine, the third point positioned further away from the base than is the fourth point, and the fourth point positioned further away from the first tine than is the third point.

* * * * *